US006452618B1

(12) United States Patent
Heim

(10) Patent No.: US 6,452,618 B1
(45) Date of Patent: Sep. 17, 2002

(54) CARRIAGE VELOCITY CONTROL TO IMPROVE PRINT QUALITY AND EXTEND PRINTHEAD LIFE IN INK-JET PRINTER

(75) Inventor: Rory A. Heim, Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/594,889

(22) Filed: Jun. 14, 2000

Related U.S. Application Data

(63) Continuation-in-part of application No. 08/995,774, filed on Dec. 22, 1997, now Pat. No. 6,145,959.

(51) Int. Cl.[7] ..... B41J 2/01
(52) U.S. Cl. ..... 347/140; 347/15; 347/37
(58) Field of Search ..... 347/19, 37, 14, 347/56, 17, 15, 40, 12

(56) References Cited

U.S. PATENT DOCUMENTS 4,855,752 A 8/1989 Bergstedt ..... 346/1.1
4,910,528 A * 3/1990 Firl et al. ..... 347/17
5,166,699 A * 11/1992 Yano et al. ..... 347/17
5,477,245 A 12/1995 Fuse ..... 347/10
5,524,993 A * 6/1996 Durst ..... 347/17
5,644,683 A 7/1997 Ross et al. ..... 395/108
5,757,400 A 5/1998 Hoisington ..... 347/40
5,760,798 A 6/1998 Suzuki et al. ..... 347/14
6,012,792 A * 1/2000 Sievert et al. ..... 347/3
6,145,959 A * 11/2000 Lund et al. ..... 347/19

FOREIGN PATENT DOCUMENTS

EP 0720917 A 7/1996 ..... B41J/2/205

* cited by examiner

*Primary Examiner*—Craig A. Hallacher

(57) ABSTRACT

An inkjet printer uses a printhead that passes repeatedly across a print medium in individual swaths. The printhead has individual nozzles that are fired repeatedly during each printhead swath to apply an ink pattern to the print medium. Before any given swath, the printer analyzes factors that might require a reduction in print density. Anticipated printhead temperature is one factor that might require a reduction in print density. The printer monitors the print density and a printhead temperature during each printhead swath. It then uses these values to calculate, prior to each new swath, a maximum permissible print density. If a reduction in print density is indicated, the printer temporarily reduces the printhead velocity relative to the page.

21 Claims, 4 Drawing Sheets

CARRIAGE VELOCITY CONTROL TO IMPROVE PRINT QUALITY AND EXTEND PRINTHEAD LIFE IN INK-JET PRINTER

CROSS-REFERENCE TO RELATED APPLICATION

This application is a continuation-in-part of application Ser. No. 08/995,774, filed Dec. 22, 1997, SWATH DENSITY CONTROL TO IMPROVE PRINT QUALITY AND EXTEND LIFE IN INK-JET PRINTER, by Mark D. Lund, Rory A. Heim and Steven T. Castle, now U.S. Pat. No. 6,145,959, the entire contents of which are incorporated herein by this reference.

TECHNICAL FIELD OF THE INVENTION

This invention relates to printers, and more particularly to techniques for improving print quality and for extending printhead life in ink-jet printers.

BACKGROUND OF THE INVENTION

Ink-jet printers operate by sweeping a printhead with one or more ink-jet nozzles above a print medium and applying a precise quantity of ink from specified nozzles as they pass over specified pixel locations on the print medium. One type of ink-jet nozzle utilizes a small resistor to produce heat within an associated ink chamber. To fire a nozzle, a voltage is applied to the resistor. The resulting heat causes ink within the chamber to quickly expand, thereby forcing one or more droplets from the associated nozzle. Resistors are controlled individually for each nozzle to produce a desired pixel pattern as the printhead passes over the print medium.

To achieve higher pixel resolutions, printheads have been designed with large numbers of nozzles. This has created the potential for printhead overheating. Each nozzle firing produces residual heat. If too many nozzles are fired within a short period of time, the printhead can reach undesirably high temperatures. Such temperatures can damage and shorten the life of a printhead. Furthermore, widely varying printhead temperatures during printing can change the size of droplets ejected from the nozzles. This has a detrimental effect on print quality.

Printhead overheating is often the result of a high "dot density" during a single swath of the printhead. When making a swath, the printhead passes over a known number of available pixels, some of which will receive ink and others of which will not receive ink. The pixels that receive ink are referred to as dots. The "dot density" is the percentage of pixels in a swath that receives ink and thereby become dots. When printing many types of images, such as text images, dot densities are relatively low and do not cause overheating. More dense images such as photographic images, however, require a much higher dot density and create the distinct potential for overheating.

Another problem caused by printing high-density images is that there might be insufficient ink in the nozzle area of the printhead for printing the next swath. Over time, firing a nozzle when it has an insufficient supply of ink will destroy the nozzle.

Generally, it is known to deal with both these problems by pausing the printhead. Where excessive printhead temperature is a concern a pause is utilized to allow the printhead to cool. Similarly, a pause is used to allow additional ink to flow into the nozzle area of the printhead.

The above referenced application, SWATH DENSITY CONTROL TO IMPROVE PRINT QUALITY AND EXTEND LIFE IN INK-JET PRINTER, describes techniques which address these problems, including disabling nozzles in the printhead, and providing reduced-height swaths to reduce throughput. This application provides additional techniques for addressing these problems.

SUMMARY OF THE INVENTION

A method is described for controlling average printing density over time in an inkjet printer having a printhead with a plurality of nozzles, the printhead mounted in a scanning carriage for producing a print swath across a print medium. The method includes:

moving the carriage to the printhead repeatedly across a print medium in individual swaths;

firing individual nozzles repeatedly during each printhead swath to apply an ink pattern to the print medium;

reducing the carriage velocity during a particular swath.

The carriage velocity reduction can occur as a result of one of several occurrences. For example, the step of reducing the carriage velocity can be performed in response to high print densities that are predicted to raise the printhead temperature to unacceptably high levels.

In accordance with another aspect of the invention, an inkjet printer that applies an ink pattern to a print medium is described, and includes control logic, a printhead, and a carriage for mounting the printhead. The carriage is responsive to the control logic to pass the printhead repeatedly across the print medium in individual swaths, the printhead having individual nozzles that are fired repeatedly during each printhead swath to apply an ink pattern to the print medium. The control logic determines a swath dot density prior to each swath. If the swath density of an upcoming swath is greater than a maximum permissible swath density, the control logic acts to reduce the carriage velocity during the upcoming swath to produce a swath with reduced print density.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENTS

Figure 1:
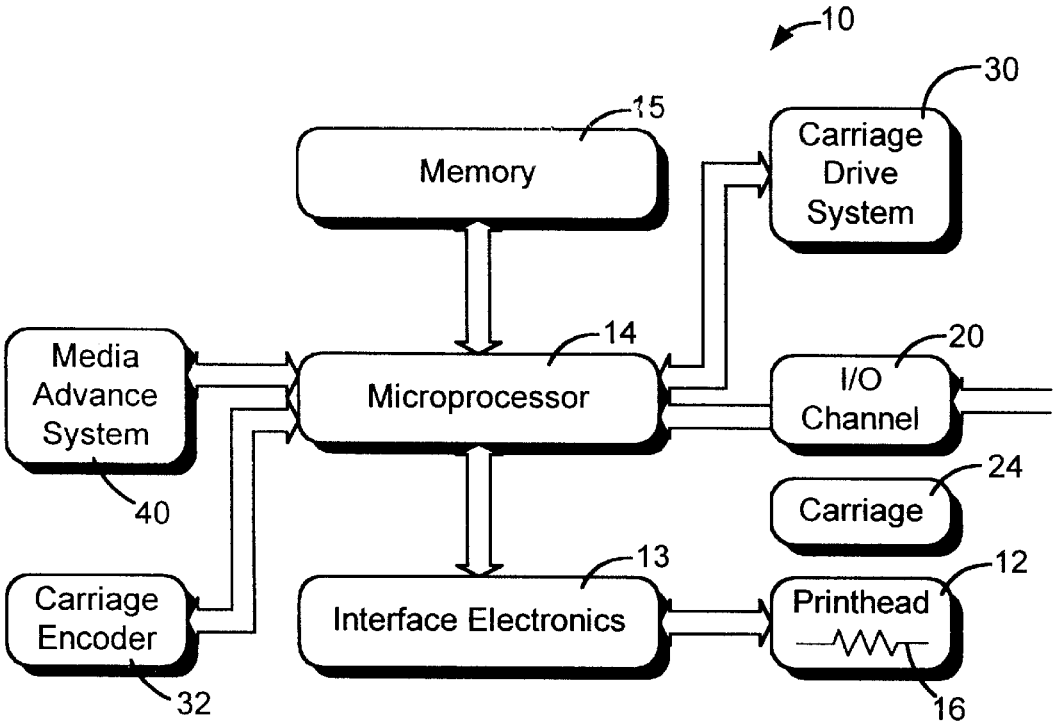
FIG. 1 is a block diagram showing pertinent components of an inkjet printer in accordance with the invention.

FIG. 1 shows pertinent components of a printer 10 in accordance with the invention. Printer 10 is an ink-jet printer having a printhead 12. The printhead has multiple nozzles (not shown in FIG. 1). Interface electronics 13 are associated with printer 10 to interface between the control logic components and the electro-mechanical components of the printer. Interface electronics 13 include, for example, circuits for moving the printhead and paper, and for firing individual nozzles.

Printer 10 includes control logic in the form of a microprocessor and associated memory 15. Microprocessor 14 is programmable in that it reads and serially executes program instructions from memory. Generally, these instructions carry out various control steps and functions that are typical of inkjet printers. In addition, the microprocessor monitors and controls inkjet peak temperatures as explained in more detail below. Alternatively an ASIC or hard-wired logic could be employed in place of the microprocessor. Memory 15 is preferably some combination of ROM, dynamic RAM, and possibly some type of non-volatile and writable memory such as battery-backed memory or flash memory.

A temperature sensor 16 is associated with the printhead. It is operably connected to supply a printhead temperature measurement to the control logic through interface electronics 13. The temperature sensor in the described embodiment is a thermal sense resistor. It produces an analog signal that is digitized within interface electronics 13 so that it can be read by microprocessor 14. More details regarding the temperature sensor, its calibration, and its use are given in U.S. Pat. No. 6,196,651, entitled "Method and Apparatus for Detecting the End of Life of a Print Cartridge For a Thermal Ink Jet Printer," the entire contents of which are hereby incorporated by reference.

Microprocessor 14 is connected to receive instructions and data from a host computer (not shown) through one or more I/O channels or ports 20. I/O channel 20 is a parallel or serial communications port such as used by many printers.

Figure 2:
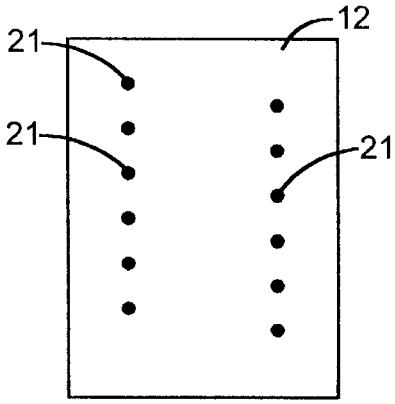
FIG. 2 is a conceptual representation of a printhead usable in the printer of FIG. 1.

FIG. 2 shows an exemplary layout of nozzles 21 in one example of a printhead 12. Printhead 12 has one or more laterally spaced nozzle or dot columns. Each nozzle 21 is positioned at a different vertical position (where the direction of printhead travel, at a right angle to the direction of printhead travel), and corresponds to a respective pixel row on the underlying print medium. In most swaths of the printhead, all nozzles are used resulting in what is referred to herein as a full-height swath.

Many different printhead configurations are of course possible, and the invention is not limited to the simplified example shown in FIG. 2. In a current embodiment of the invention, for example, the printhead has nozzles corresponding to 288 pixel rows. Also, some printheads utilize redundant columns of nozzles for various purposes. Furthermore, color printers typically have three or more sets of nozzles positioned to apply ink droplets of different colors on the same pixel rows. The sets of nozzles might be contained within a single printhead, or incorporated in three different printheads. The principles of the invention described herein apply in either case.

Generally, printhead 12 is responsive to the control logic implemented by microprocessor 14 and memory 15 to pass repeatedly across a print medium in individual, horizontal swaths. The printhead 12 is mounted in a carriage 24, which is mounted for sliding movement along a swath axis to print a swath. The carriage is coupled to a carriage drive system 30, which is controlled by the control logic to drive the carriage in a controlled manner. Typically, an encoder system 32 provides position information to the control logic so that the control logic can monitor the position and hence the velocity of the carriage as it is moved by the drive system 30 in response to commands from the control logic. A media advance system 40 is also controlled by the control logic to drive and position the print media along a media path which is generally transverse to the swath axis.

The individual nozzles of the printhead are fired repeatedly during each printhead swath to apply an ink pattern to the print medium. In some printers, the swaths overlap each other so that the printhead passes over each pixel row two or more times.

For some applications, the techniques described in the above-referenced application may not be available, e.g. because the data pipeline may not be able to accommodate swath height reductions. One such pipeline is implemented using the printer command language (PCL) protocol. The techniques in accordance with this invention can be employed to address the above described problems. In accordance with the invention, the carriage movement rate is slowed down for selected swaths to reduce print density. The carriage rate reduction can be employed in response to any one of the following factors or conditions: (a) a high print density for the swath, which is predicted to raise the printhead temperature to an unacceptably high level; and (b) a high print density for the swath that is predicted to lower nozzle ink supplies to unacceptably low levels.

In accordance with the invention, the control logic is configured to perform a learning algorithm, which in an exemplary implementation uses some known values for a complete swath: the actual density, $D_{ACT}$, the maximum allowed printhead temperature, $T_{MAX}$, the printhead temperature at the beginning of the swath, $T_{START}$, and the actual peak printhead temperature during the swath, $T_{PEAK}$. The invention is not limited to basing calculations solely on values from the complete swath, and can be employed when the swath is divided into discrete swath intervals, and the values are determined for each swath interval. Once the swath is completed, the actual density, $D_{ACT}$, is found by reading registers in the printer hardware, i.e. the controller memory in which the actual ink drop counts for each printhead are stored.

An exemplary learning equation for the algorithm, calculated after the swath completes, follows:

$$D_{MAX}=D_{ACT}*A*B,$$

where $A=(CVEL_{MAX}/MECH_/CVEL_{MAX})$, $B=(T_{MAX}-T_{START})/(T_{PEAK}-T_{START})$, $CVEL_{MAX}$ is the maximum allowed carriage velocity for the swath, and $MECH_CVEL_{MAX}$ is the maximum velocity allowed for the print mode.

This learning equation yields the effective firing density which is a function of carriage velocity.

To ensure that the printheads do not run at a temperature greater than a set thermal limit $T_{MAX}$, say 70 degrees C. in one implementation, the printer swath manager builds a swath and then estimates the expected average density $D_{AVG}$ for that swath or interval. Once the expected average density is known, the following swath-pre-processing equation, calculated prior to releasing the swath, is applied to determine the maximum allowed carriage velocity ($CVEL_{MAX}$) for that swath. The highest possible carriage velocity is the maximum velocity ($MECH_CVEL_{MAX}$) allowed for the print mode, and is limited to the actual carriage mechanism.

$$CVEL_{MAX}=\mathrm{MIN}[((MECH_CVEL_{MAX})*(D_{MAX})/(D_{AVG})),\ (MECH_CVEL_{MAX})]$$

Once the maximum allowed carriage velocity ($CVEL_{MAX}$) is calculated, the velocity will typically be floored to the next closest allowable carriage velocity based on the frequency response of the printhead.

These two equations provide as benefits their adaptability to many writing systems constraints and their flexibility to future product changes, such as a faster carriage velocity or higher resolution printheads. Characterization of flight-time-compensation and ink-dry-time interactions can be incorporated in the algorithms.

The printing system can employ these equations to provide on the basis of complete swath parameters, e.g. the maximum print density and printhead temperatures measured or predicted over the entire print swath, i.e., a whole or full swath mode. While a whole swath mode can be satisfactory for many applications, there can be a possible disadvantage, in that drastically different swaths can end up with similar average densities and peak temperatures. When this occurs, the algorithm can require heavy filtering to dampen the noise of the calculated maximum allowed density, and this would likely occur for the calculation of $CVEL_{MAX}$ if intra-swath techniques are not employed. For example, consider a worst-case type example, wherein the swath has four intervals. The print density is 100% for the first two swath intervals, and 0% for the last two swath intervals. For a full swath mode calculation, $D_{ACT}$ will be 50%, which may not adequately address the disparate density values and resulting printhead temperature effects. To address the effects of a print density which is not uniform, the invention can be applied in an intra-swath mode.

Dividing the swath into discrete intervals for the intra-swath mode allows a better estimation of the printhead thermal response than if the algorithm makes decisions based solely on the average density and peak temperature for an entire swath. The algorithm mode using discrete swath interval calculations will be very similar to the whole swath implementation described above. However, when in an intra-swath mode, the $D_{MAX}$ and $CVEL_{MAX}$ parameters will be calculated at discrete intervals across the swath and then the results will be statistically combined for the complete swath. The only disadvantage to this intra-swath mode is the increase in CPU cycles required for the extra calculations.

There are various techniques which could be used to combine the swath interval parameters. For example, before allowing a swath to print, for each interval, the parameter $D_{AVG}$ is estimated for each interval. The average value for $D_{AVG}$ over the intervals is then calculated. The density cannot be greater than 100 or less than 0. If the average value calculated is greater than 100 or less than 0, the parameter value is set to the boundary limit. Now the process to determine whether the swath can be allowed to be printed at the maximum carriage velocity is the same as for the full swath technique. After the swath is completed, the learning equation is applied to each interval and the $D_{MAX}$ values for each interval are averaged together to obtain the $D_{MAX}$ parameter value to be used for the next swath.

Figure 3A:
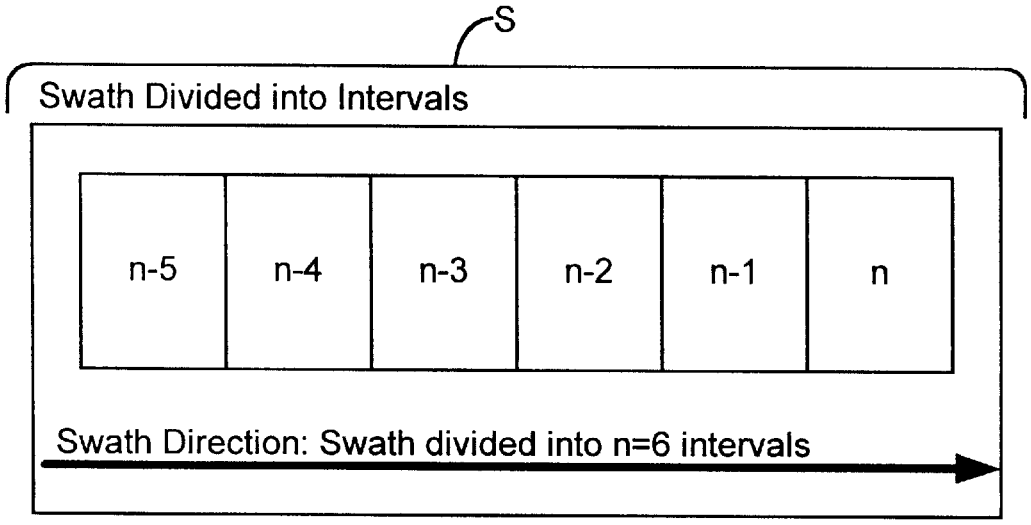
FIG. 3A illustrates in a diagrammatic fashion an exemplary print swath S, divided into n=6 swath intervals in accordance with an aspect of the invention.
Figure 3B:
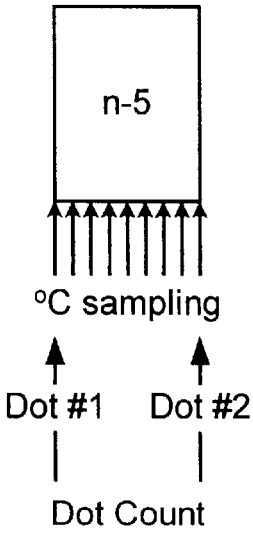
FIG. 3B shows an exemplary swath interval (n−5).

FIG. 3A illustrates in a diagrammatic fashion an exemplary print swath S, divided into n=6 swath intervals. FIG. 3B shows an exemplary swath interval (n−5). During the swath interval n−5, the control logic 14 samples the printhead temperature at some frequency C, and averages the temperature values over the interval. At the beginning of this interval, the printer records in memory the dot count as $DOT_1$ from the control logic. At the end of the interval the control logic again records the dot counts (for each color) as $DOT_2$. This dot count information is enough information to calculate the number of dots fired in that interval per color, as well as calculate the average firing frequency with the known carriage velocity. For a system employing multiple print pens and colors, the dot counts for each color are tracked, and the average firing density $D_{AVG}$ for each color is calculated. Typically the pen with the minimum $D_{MAX}$ will take precedence.

The algorithms are not limited to the case in which the peak temperature is used in the calculations, and other values can alternatively be employed, such as average temperature and various time/temperature values or combinations thereof.

Figure 4:
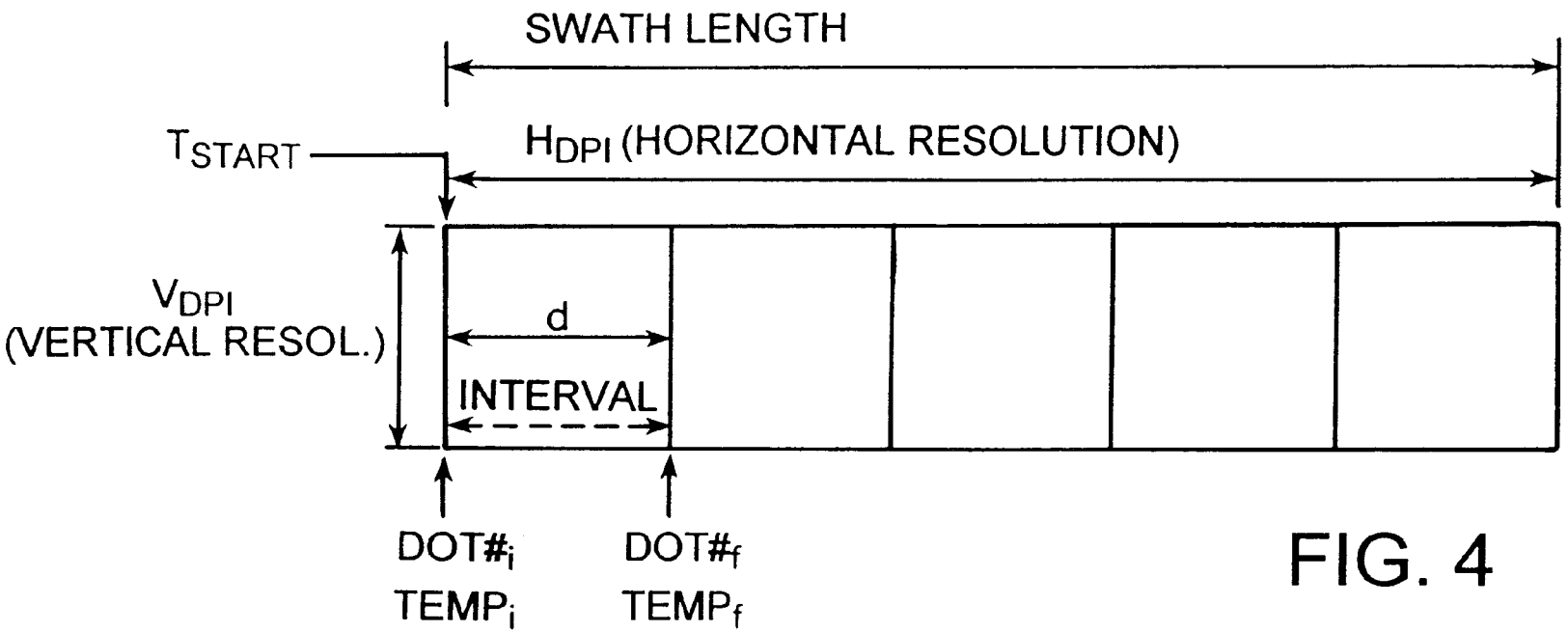
FIG. 4 illustrates an alternate intra-swath technique in accordance with aspects of the invention.

FIG. 4 illustrates an alternate intra-swath technique in accordance with aspects of the invention. FIG. 4 illustrates a swath having a swath length indicated by $H_{dpi}$, the total number of possible dots over the horizontal extent of the swath, and a swath height indicated by $V_{dpi}$, the total number of possible dots over the vertical extent of the swath. The swath is divided into five intervals, each having a total number d=(SWATH_LENGTH)/(INTERVAL_COUNT) of possible dots over the horizontal extent. There is an initial dot count ($DOT\#_i$) and printhead temperature $TEMP_i$, and a final dot count ($DOT\#_f$) and printhead temperature $TEMP_f$ for each interval. For this example, for each interval:

$$\text{FIRING_DENSITY}=(DOT\#_f-DOT\#_i)/(V_{dpi}*H_{dpi}*D)$$

$$\Delta T=TEMP_f=TEMP_i$$

Prior to printing a swath in this alternate embodiment, the algorithm will perform several steps. First, estimate $D_{AVG_INTERVAL}$ for each interval. Second, look up each ΔT allowed for each interval from a stored table, or determine each ΔT using a best fit to a mathematically derived equation, e.g. an $n^{th}$ order polynomial, based on each interval's $D_{AVG_INTERVAL}$ value. The latter technique reduces the amount of required memory space, but at the expense of increased cpu loading. Third, sum each ΔT from each interval, and perform a decision, as follows:

$$\Delta T_{TOTAL}=\Delta T(D_{AVG_INTERVAL\ 1)TABLE})+\Delta T(D_{AVG_INTERVAL\ 2)TABLE})+\ldots\ \Delta T(D_{AVG_INTERVAL\ n)TABLE}).$$

IF $$\Delta T_{TOTAL}>(T_{MAX}-T_{START}),\ \text{THEN "SLOW VELOCITY"},\ C_{VEL_MAX}=\text{MIN}[(T_{MAX}-T_{START})/\Delta T_{TOTAL})*MECH_CVEL_{MAX},\ MECH_CVEL_{MAX}]$$

END IF

After each swath has printed, the following steps are conducted. First, for each interval of the printed swath, find $D_{ACT}$. Next, for each interval of the printed swath, calculate ΔT and the effective firing density $D_{ACT_EFF}$, $$D_{ACT_EFF}=D_{ACT}(C_{VEL_MAX}/MECH_CVEL_{MAX})$$

For each interval with a corresponding $D_{ACT_EFF}$ and ΔT, the appropriate table that corresponds to the print mode in use is updated:

| $D_{ACT_EFF}$ | ΔT |
|---|---|
| 0–.99 | Running Average of ΔT |
| 1–1.99 | Running Average of ΔT |
| . | . |
| . | . |
| . | . |
| 99–100 | Running Average of ΔT |

Alternatively, when a best fit technique is employed instead of updating an interval fill table as described above, the equation can be updated with the results just learned on the preceding swath print.

Figure 5:
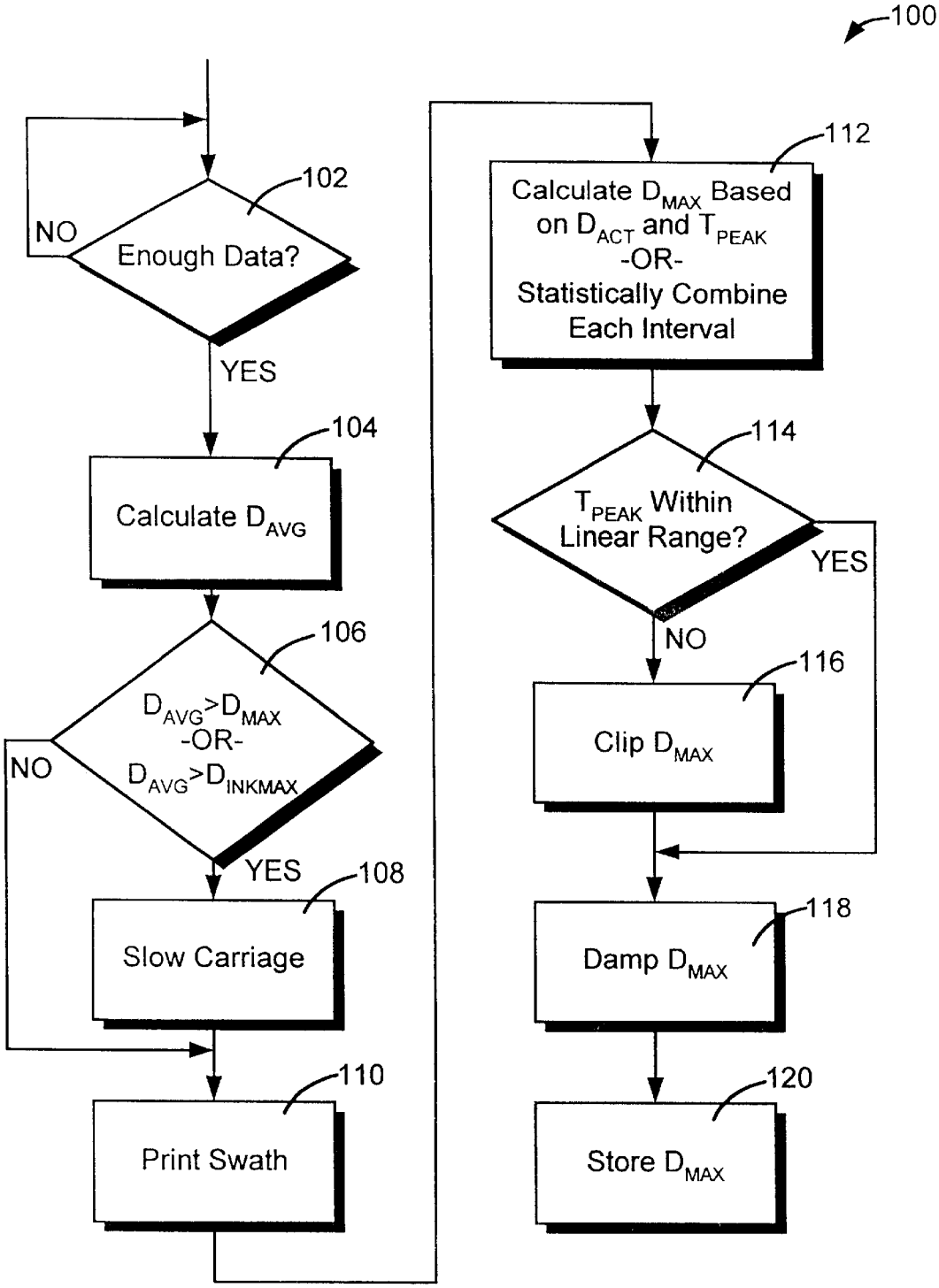
FIG. 5 is a flowchart showing steps performed in accordance with aspects of the invention.

FIG. 5 illustrates a method 100 for controlling a printer in accordance with aspects of the present invention. The steps of FIG. 5 are performed by the control logic of the printer 10, and are repeated prior to every printhead swath for the full swath mode, and for each swath interval for the intra-swath mode.

A first step 102 involves checking whether enough data has been received from the host computer to print an entire swath. Once enough data has been received to print a swath, execution proceeds with step 104.

Step 104 comprises calculating the average swath density $D_{AVG}$ for the upcoming swath. This is done by the printer swath manager building the upcoming swath, and estimating the expected average density $D_{AVG}$. A next step 106 is to determine whether the carriage velocity is to be slowed to reduce the effective print density. This step comprises comparing $D_{AVG}$ to $D_{MAX}$, where $D_{MAX}$ is calculated using the learning equation set out above upon completion of the prior swath. Optionally, step 106 can include determining whether the carriage should be slowed because the ink flow rate to the printhead is nearing or exceeding a threshold. For many applications, the limiting factor is the thermal limitation, and so ink flow to the printhead need not be employed in the algorithm. However, for some applications, the ink flow can be a limiting factor, and in this case, a density parameter $D_{MAXINK}$ can be created, which is a maximum density value which can be printed by the printhead without damage. If this variable exceeds some predetermined threshold, say 95%, the effective print density is limited to some percentage of the print density maximum, say 75%, by slowing the carriage. In this case, step 106 also includes comparing $D_{AVG}$ to $D_{INKMAX}$. If $D_{AVG}>D_{MAX}$ or if $D_{AVG}>D_{INKMAX}$, a step 108 is performed of slowing the printer carriage.

Step 110 comprises printing the swath using the carriage velocity calculated according to the swath pre-processing equation set out above. The control logic monitors the printhead temperature during this step, and records the temperature parameters, e.g. $T_{PEAK}$ and $T_{START}$, for later use.

$D_{MAX}$ is a potentially changing value that is maintained by the control logic based on known and measured characteristics of the printhead. The maximum possible ink flow rate establishes the upper limit of $D_{MAX}$. The upper limit of $D_{MAX}$ is established at a value that produces an average ink flow rate of less than or equal to the maximum possible ink flow rate. Subject to this upper limit, $D_{MAX}$ is updated during printer operation based on recorded start and peak temperatures for the printhead during previous swaths having known print densities.

In the described embodiment of the invention, the printer control logic calculates $D_{MAX}$ by monitoring actual swath dot density, the printhead start temperature $T_{START}$ and the peak printhead temperature $T_{PEAK}$ during each printhead swath and repeatedly (after each swath) calculates $D_{MAX}$ as a function of the actual swath dot density $D_{ACT}$, the start temperature $T_{START}$, peak temperature $T_{PEAK}$ and the carriage velocity ratio A. $D_{MAX}$ is calculated so that a printhead swath in which $D_{ACT}=D_{MAX}$ results in a peak printhead temperature that does not exceed a maximum permissible peak printhead temperature $T_{MAX}$.

$D_{MAX}$ is calculated by multiplying the actual swath dot density $D_{ACT}$ of a particular printhead swath by a factor that is based at least in part on the peak temperature $T_{PEAK}$ of the printhead during the swath and upon a specified maximum permissible temperature $T_{MAX}$ of the printhead. In the embodiment described herein, the factor is equal to $A^*(T_{MAX}-T_{START})/(T_{PEAK}-T_{START})$; where $T_{START}$ is equal to the temperature of the printhead prior to the printhead swath. $T_{START}$ is a constant that approximates the printhead temperature at the beginning of each swath. In the described embodiment, printhead control logic within printer 10 heats or cools the printhead to a target temperature before each printhead swath. $T_{START}$ is equal to this target temperature. Printhead cooling is achieved by imposing a brief delay before an upcoming swath. Printhead heating is achieved by a technique known as "pulse warming," in which nozzles are repeatedly pulsed with electrical pulses of such short duration that they produce heat without ejecting ink.

$D_{MAX}$ is updated after each swath as follows:

$$D_{MAX}=D_{ACT}*A*((T_{MAX}-T_{START})/(T_{PEAK}-T_{START}))$$

This equation is derived as follows: First, it is assumed that there is a linear relationship between printhead density D and printhead temperature T. Thus, $$T=m*D_{ACT}+T_{START} \quad (1)$$

Given this relationship, $D_{MAX}$ can be calculated in terms $T_{MAX}$, $T_{START}$, and the slope m:

$$D_{MAX}=A*(T_{MAX}-T_{START})/m \quad (2)$$

Solving for m, $$m=A*(T_{MAX}-T_{START})/D_{MAX} \quad (3)$$

Substituting equation (3) into equation (1) yields $$T=A*((T_{MAX}-T_{START})/D_{MAX})*D_{ACT}*A+T_{START} \quad (4)$$

Solving for $D_{MAX}$ $$D_{MAX}=D_{ACT}*A*((T_{MAX}-T_{START})/(T-T_{START})) \quad (5)$$

So, given a temperature $T_{PEAK}$ that occurs during a printhead swath having a density $D_{ACT}$, $$D_{MAX}=D_{ACT}*A*((T_{MAX}-T_{START})/(T_{PEAK}-T_{START})) \quad (6)$$

Actual changes to $D_{MAX}$ can be filtered to reduce fluctuations produced by measurement anomalies. One method of filtering is to clip each new value of $D_{MAX}$ at upper and lower limits. In this exemplary embodiment, such clipping is performed only if the printhead temperature $T_{PEAK}$ is outside a defined temperature range, wherein the range includes those temperatures that have been determined to be associated with a linear density/temperature relationship.

Another method of filtering is to damp any changes in the calculated $D_{MAX}$. In the described embodiment, this is done by multiplying changes to $D_{MAX}$ by a predetermined damping factor. Preferably, upward changes in the calculated $D_{MAX}$ are damped by a first damping factor, and downward changes are damped by a second, different damping factor.

FIG. 4 illustrates the steps 112–120 involved in calculating $D_{MAX}$. The illustrated steps are performed repeatedly, after each printhead swath. $D_{ACT}$ and $T_{PEAK}$ are recorded during the preceding swath, and are utilized in the calculations of FIG. 4.

A step 112 comprises calculating $D_{MAX}$ as a function of $D_{ACT}$ and $T_{PEAK}$, in accordance with equation (6) above. Subsequent decision step 114 comprises determined whether $T_{PEAK}$ is within a temperature range that exhibits a linear relationship to printhead density. This step comprises comparing $T_{PEAK}-T_{START}$ with a predefined constant that represents the upper temperature limit of linear printhead behavior. If $T_{PEAK}-T_{START}$ is less than or equal to the constant, execution proceeds to step 118. If $T_{PEAK}$ is greater than the constant, a step 116 is performed of clipping $D_{MAX}$ at predefined upper and lower limits. As an example, the upper and lower limits might be set to 95% and 80%, respectively. Step 116 clips or limits $D_{MAX}$ to these values. Any value of $D_{MAX}$ above the upper limit is set equal to the upper limit.

Performed after the clipping steps described above, step 118 comprises damping changes in $D_{MAX}$ from one printhead pass to another. To do this, the change $\Delta D_{MAX}$ is calculated as the $D_{MAX}-D_{MAXOLD}$, where $D_{MAXOLD}$ is the value of $D_{MAX}$ calculated during the previous iteration of the steps 112–120. $D_{MAX}$ is then damped as follows: $D_{MAX}=D_{MAX}-\Delta D_{MAX}/F_{DAMP}$, where $F_{DAMP}$ is a predetermined damping factor. Alternatively, two different damping factors are used: one when $\Delta D_{MAX}$ is positive, and another when $\Delta D_{MAX}$ is negative. Furthermore, in some cases it may be advantageous to perform damping step 118 only when the absolute value of $\Delta D_{MAX}$ is greater than some predetermined density. This gives a range of $\Delta D_{MAX}$ in which damping is not performed. The use of an intra-swath mode in accordance with an aspect of the invention decreases the need for dampening and increases the accuracy of the calculations.

Step 120 comprises storing $D_{MAX}$ in non-volatile storage, for retention when the printer is turned off. This value of $D_{MAX}$ is used in step 102, prior to the next printhead swath.

Note that the calculations above are based on an assumption that printhead thermal behavior is linear. This simplifies calculations and makes it possible to predict printhead temperatures without requiring significant amounts of non-volatile storage. Other approaches can be used. For example, a different mathematical model (other than the linear model) can be used to predict printhead thermal behavior. Alternatively, a table in printer memory can be maintained, indicating historical peak temperatures corresponding to different printhead densities. In this case, the table is used to determine $D_{MAX}$ rather than the linear model described above.

The method described above of reducing printhead density can be adapted to various different print methodologies. For example, many printers utilize swath overlapping to reduce banding. The principles explained above can be easily incorporated in such printers.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A method of controlling average printing density over time in an inkjet printer having a printhead with a plurality of nozzles, the printhead mounted in a scanning carriage to produce print swaths across a print medium, comprising the following steps:

moving the carriage to pass the printhead repeatedly across a print medium in individual swaths;

firing individual nozzles repeatedly during each printhead swath to apply an ink pattern to the print medium;

calculating swath dot density prior to each swath;

if the swath dot density of an upcoming swath is greater than a maximum permissible swath density, reducing the velocity of the carriage during the upcoming swath to produce a swath with reduced print density.

2. The method of claim 1 wherein said step of calculating swath dot density prior to each swath includes computing said swath dot density over the entire swath.

3. The method of claim 1 wherein said step of calculating swath dot density includes:

dividing the swath into a plurality of swath intervals;

for each swath interval, calculating a maximum permissible dot density;

statistically combining the calculated interval values for the maximum permissible dot density to determine the maximum permissible swath dot density.

4. The method of claim 3 wherein said step of statistically combining the calculated interval values includes calculating an average value for the interval values.

5. An inkjet printer that applies an ink pattern to a print medium, the printer comprising:

control logic;

a printhead;

a carriage for mounting the printhead, the carriage responsive to the control logic to pass the printhead repeatedly across the print medium in individual swaths, the printhead having individual nozzles that are fired repeatedly during each printhead swath to apply an ink pattern to the print medium;

the control logic being configured to determine a swath dot density prior to each swath, and, if the swath density of an upcoming swath is greater than a maximum permissible swath density, to reduce the carriage velocity during the upcoming swath.

6. A method of controlling average printing density over time in an inkjet printer having a printhead with a plurality of nozzles, the printhead mounted in a scanning carriage for producing a print swath across a print medium, comprising the following steps:

moving the carriage to the printhead repeatedly across a print medium in individual swaths;

firing individual nozzles repeatedly during each printhead swath to apply an ink pattern to the print medium;

monitoring actual swath dot density and a temperature of the printhead during each printhead swath;

repeatedly calculating a maximum permissible swath dot density in response to the monitoring step as a function of the actual swath dot density and the printhead temperature, wherein the maximum permissible swath dot density results in a printhead temperature that does not exceed a maximum permissible peak printhead temperature, said calculating comprising (i) dividing the swath into a plurality of swath intervals, (ii) for each swath interval, calculating a maximum permissible dot density, and (iii) statistically combining the calculated interval values for the maximum permissible dot density to determine the maximum permissible swath dot density;

limiting swath dot density to no greater than the maximum permissible swath dot density during individual printhead swaths;

reducing the carriage velocity during a particular swath.

7. A method of controlling average printing density over time in an inkjet printer having a printhead with a plurality of nozzles, the printhead mounted in a scanning carriage for producing a print swath across a print medium, comprising the following steps:

moving the carriage to the printhead repeatedly across a print medium in individual swaths;

firing individual nozzles repeatedly during each printhead swath to apply an ink pattern to the print medium;

in response to high print densities that are predicted to lower ink supplies to the nozzles to unacceptably low levels, reducing the carriage velocity during a particular swath.

8. A method of controlling printhead temperature in an inkjet printhead having a plurality of nozzles, comprising:

passing the printhead repeatedly across a print medium in individual swaths;

firing individual nozzles repeatedly during each printhead swath to apply an ink pattern to the print medium;

monitoring an actual swath dot density and a temperature of the printhead during each printhead swath;

repeatedly calculating a maximum permissible swath dot density in response to the monitoring step as a function of the actual swath dot density and the printhead temperature, wherein the maximum permissible swath dot density results in a printhead temperature that does not exceed a maximum permissible peak printhead temperature, said calculating comprising multiplying the actual swath dot density of a particular printhead swath by a factor that is based at least in part on a peak temperature of the printhead during said particular printhead swath;

reducing the printhead velocity to limit swath dot density to no greater than the maximum permissible swath dot density during individual printhead swaths.

9. The method of claim 8, wherein said factor is further based at least in part on a specified maximum permissible temperature of the printhead.

10. The method of claim 8, wherein the calculating step for a particular print mode comprises multiplying the actual swath dot density of a particular printhead swath by a factor that is equal to A*B; where $A=(CVEL_{MAX}/MECH_CVEL_{MAX})$, $B=(T_{MAX}-T_{START})/(T_{PEAK}-T_{START})$, $T_{MAX}$ is the peak temperature of the printhead during said particular printhead swath, $T_{PEAK}$ is a specified maximum permissible temperature of the printhead, $T_{START}$ approximates the temperature of the printhead prior to said particular printhead swath, $CVEL_{MAX}$ is the maximum allowed carriage velocity for the swath, and $MECH_CVEL_{MAX}$ is the maximum velocity allowed for the print mode.

11. The method of claim 8, wherein the calculating step comprises:

clipping the calculated maximum permissible swath dot density at upper and lower limits;

damping changes in the calculated maximum permissible swath dot density.

12. The method of claim 8, wherein the calculating step comprises, for a particular print mode:

multiplying the actual swath dot density of a particular printhead swath by a factor that is equal to A*B; where $A=(CVEL_{MAX}/MECH_CVEL_{MAX})$, $B=(T_{MAX}-T_{START})/(T_{PEAK}-T_{START})$, $T_{MAX}$ is the peak temperature of the printhead during said particular printhead swath, $T_{PEAK}$ is a specified maximum permissible temperature of the printhead, $T_{START}$ approximates the temperature of the printhead prior to said particular printhead swath, $CVEL_{MAX}$ is the maximum allowed carriage velocity for the swath, and $MECH_CVEL_{MAX}$ is the maximum velocity allowed for the print mode;

damping upward changes in the calculated maximum permissible swath dot density by a first factor; and damping downward changes in the calculated maximum permissible swath dot density by a second factor;

clipping the calculated maximum permissible swath dot density at upper and lower limits if the printhead temperature during said particular printhead swath is outside a defined range.

13. A method of controlling printhead temperature in an inkjet printhead having a plurality of nozzles, comprising:

passing the printhead repeatedly across a print medium in individual swaths;

firing individual nozzles repeatedly during each printhead swath to apply an ink pattern to the print medium;

monitoring an actual swath dot density and a temperature of the printhead during each printhead swath;

repeatedly calculating a maximum permissible swath dot density in response to the monitoring step as a function of the actual swath dot density and the printhead temperature, wherein the maximum permissible swath dot density results in a printhead temperature that does not exceed a maximum permissible peak printhead temperature, wherein said calculating a maximum permissible swath dot density further comprises damping changes in the calculated maximum permissible swath dot density;

reducing the printhead velocity to limit swath dot density to no greater than the maximum permissible swath dot density during individual printhead swaths.

14. The method of claim 13, wherein the calculating step comprises:

damping upward changes in the calculated maximum permissible swath dot density by a first factor; and damping downward changes in the calculated maximum permissible swath dot density by a second factor.

15. A method of controlling printhead temperature in an inkjet printhead having a plurality of nozzles, comprising:

passing the printhead repeatedly across a print medium in individual swaths;

firing individual nozzles repeatedly during each printhead swath to apply an ink pattern to the print medium;

monitoring an actual swath dot density and a temperature of the printhead during each printhead swath;

repeatedly calculating a maximum permissible swath dot density in response to the monitoring step as a function of the actual swath dot density and the printhead temperature, wherein the maximum permissible swath dot density results in a printhead temperature that does not exceed a maximum permissible peak printhead temperature, wherein said calculating a maximum permissible swath dot density further comprises clipping the calculated maximum permissible swath dot density at upper and lower limits;

reducing the printhead velocity to limit swath dot density to no greater than the maximum permissible swath dot density during individual printhead swaths.

16. The method of claim 15, wherein said clipping the calculated maximum permissible swath dot density at upper and lower limits is performed if the printhead temperature during said particular printhead swath is outside a defined range.

17. An inkjet printer that applies an ink pattern to a print medium, the printer comprising:

control logic;

a printhead that is responsive to the control logic to pass repeatedly across the print medium in individual swaths, the printhead having individual nozzles that are fired repeatedly during each printhead swath to apply an ink pattern to the print medium;

a temperature sensor associated with the printhead;

the temperature sensor being operably connected to supply a printhead temperature measurement to the control logic;

the control logic being configured to:

monitor actual swath dot density and a temperature of the printhead during each printhead swath;

repeatedly calculate a maximum permissible swath dot density in response to the monitoring step as a function of the actual swath dot density and the printhead temperature, by multiplying the actual swath dot density of a particular printhead swath by a factor that is based at least in part on a temperature of the printhead during said particular printhead swath, wherein the maximum permissible swath dot density results in a peak printhead temperature that does not exceed a maximum permissible peak printhead temperature;

reduce the printhead velocity to limit swath dot density to no greater than the maximum permissible swath dot density during individual printhead swaths.

18. The printer of claim 17, wherein the control logic is adapted to calculate said maximum permissible swath density by multiplying the actual swath dot density of a particular printhead swath by a factor that is equal to A*B; where $A=(CVEL_{MAX}/MECH_CVEL_{MAX})$, $B=(T_{MAX}-T_{START})/(T_{PEAK}-T_{START})$, $T_{MAX}$ is the peak temperature of the printhead during said particular printhead swath, $T_{PEAK}$ is a specified maximum permissible temperature of the printhead, $T_{START}$ approximates the temperature of the printhead prior to said particular printhead swath, $CVEL_{MAX}$ is the maximum allowed carriage velocity for the swath, and $MECH_CVEL_{MAX}$ is the maximum velocity allowed for the print mode.

19. The printer of claim 17, wherein the control logic is adapted to calculate said maximum permissible swath density by:

multiplying the actual swath dot density of a particular printhead swath by a factor that is equal to A*B; where $A=(CVEL_{MAX}/MECH_CVEL_{MAX})$, $B=(T_{MAX}-T_{START})/(T_{PEAK}-T_{START})$, $T_{MAX}$ is the peak temperature of the printhead during said particular printhead swath, $T_{PEAK}$ is a specified maximum permissible temperature of the printhead, $T_{START}$ approximates the temperature of the printhead prior to said particular printhead swath, $CVEL_{MAX}$ is the maximum allowed carriage velocity for the swath, and $MECH_CVEL_{MAX}$ is the maximum velocity allowed for the print mode;

damping upward changes in the calculated maximum permissible swath dot density by a first factor; and damping downward changes in the calculated maximum permissible swath dot density by a second factor;

clipping the calculated maximum permissible swath dot density at upper and lower limits if the printhead temperature during said particular printhead swath is outside a defined range.

20. An inkjet printer that applies an ink pattern to a print medium, the printer comprising:

control logic;

a printhead that is responsive to the control logic to pass repeatedly across the print medium in individual swaths, the printhead having individual nozzles that are fired repeatedly during each printhead swath to apply an ink pattern to the print medium;

a temperature sensor associated with the printhead;

the temperature sensor being operably connected to supply a printhead temperature measurement to the control logic;

the control logic being configured to:

monitor actual swath dot density and a temperature of the printhead during each printhead swath;

repeatedly calculate a maximum permissible swath dot density in response to the monitoring step as a function of the actual swath dot density and the printhead temperature, including damping changes in the calculated maximum permissible swath dot density, wherein the maximum permissible swath dot density results in a peak printhead temperature that does not exceed a maximum permissible peak printhead temperature;

reduce the printhead velocity to limit swath dot density to no greater than the maximum permissible swath dot density during individual printhead swaths.

21. An inkjet printer that applies an ink pattern to a print medium, the printer comprising:

control logic;

a printhead that is responsive to the control logic to pass repeatedly across the print medium in individual swaths, the printhead having individual nozzles that are fired repeatedly during each printhead swath to apply an ink pattern to the print medium;

a temperature sensor associated with the printhead;

the temperature sensor being operably connected to supply a printhead temperature measurement to the control logic;

the control logic being configured to:

monitor actual swath dot density and a temperature of the printhead during each printhead swath;

repeatedly calculate a maximum permissible swath dot density in response to the monitoring step as a function of the actual swath dot density and the printhead temperature, including clipping the maximum permissible swath dot density at upper and lower limits, wherein the maximum permissible swath dot density results in a peak printhead temperature that does not exceed a maximum permissible peak printhead temperature;

reduce the printhead velocity to limit swath dot density to no greater than the maximum permissible swath dot density during individual printhead swaths.

* * * * *